United States Patent [19]

Barnett

[11] Patent Number: 4,786,379

[45] Date of Patent: Nov. 22, 1988

[54] MEASURING CURRENT DISTRIBUTION IN AN ALUMINA REDUCTION CELL

[75] Inventor: Wray M. Barnett, Florence, Ala.

[73] Assignee: Reynolds Metal Company, Richmond, Va.

[21] Appl. No.: 158,637

[22] Filed: Feb. 22, 1988

[51] Int. Cl.[4] ..... C25B 3/06; C25C 3/20; G06F 15/46; G06G 7/58

[52] U.S. Cl. ..... 204/67; 204/1 T; 204/225; 204/245; 204/228; 324/447; 364/500

[58] Field of Search ..... 204/67, 243 R–247, 204/228, 1 T, 225; 324/444, 446, 447, 449, 72; 364/500, 502

[56] References Cited

U.S. PATENT DOCUMENTS

| | | | |
|---|---|---|---|
| 2,918,646 | 12/1959 | Davidson | 339/31 |
| 3,380,897 | 4/1968 | Dewey | 204/67 X |
| 3,491,002 | 1/1970 | Dewey | 204/67 |
| 3,622,475 | 11/1971 | Shiver et al. | 204/67 |
| 3,625,842 | 12/1971 | Bristol et al. | 204/67 |
| 3,644,877 | 2/1972 | Carbonneau | 339/108 TP |
| 3,649,954 | 3/1972 | Kurtz | 339/95 R |
| 3,812,024 | 5/1974 | Goodnow et al. | 204/67 |
| 4,024,034 | 5/1977 | Döring et al. | 204/67 |
| 4,035,771 | 7/1977 | Büsing et al. | 340/151 |
| 4,109,309 | 8/1978 | Johnstone et al. | 364/120 |
| 4,153,321 | 5/1979 | Pombrol | 339/95 B |
| 4,333,803 | 6/1982 | Seger et al. | 204/67 |
| 4,448,661 | 5/1984 | Roggen | 204/243 R |
| 4,517,059 | 5/1985 | Loch et al. | 204/14.1 |
| 4,638,441 | 1/1987 | Deczky | 204/228 X |

FOREIGN PATENT DOCUMENTS

| | | | |
|---|---|---|---|
| 188017 | 11/1965 | U.S.S.R. | 204/243 R |
| 487165 | 1/1974 | U.S.S.R. | 204/228 |

*Primary Examiner*—Donald R. Valentine
*Attorney, Agent, or Firm*—Alan T. McDonald

[57] ABSTRACT

A method and apparatus are disclosed for measuring the current distribution in an alumina reduction cell. The apparatus includes sensors attached to the anodes of the cell, a remote computer system for receiving and correlating data received from the sensors and a means for transmitting and receiving the data from the sensors to the remote computer.

10 Claims, 2 Drawing Sheets

MEASURING CURRENT DISTRIBUTION IN AN ALUMINA REDUCTION CELL

BACKGROUND OF THE INVENTION

The process for electrochemically producing aluminum from alumina is over 100 years old. Throughout its history, researchers have known that the efficiency of an alumina reduction cell is related to the distribution of electric current within the cell. Thus, in designing an alumina reduction cell, evenness of current distribution is a primary concern.

Even with this known concern for current distribution, there has been heretofore no known method for monitoring alumina reduction cells during production to observe changes in current distribution with changes in time and cell adjustments. It is thus one primary objective of the present invention to provide a method and apparatus for monitoring current distribution in an alumina reduction cell at any moment in time. It is also an objective of the present invention to observe changes in current distribution with changing conditions in the cell and to control the current distribution by adjusting the cell to provide an optimum current distribution.

THE PRESENT INVENTION

By means of the present invention, these desired objectives can be obtained.

The method of the present invention involves measuring the current level at selected anodes or at each anode in the alumina reduction cell at a given point in time, transmitting these individual current readings to a remote computer system, correlating the individual readings into a current distribution profile and optionally controlling variables in the cell in response to the current distribution profile to thereby optimize the current distribution within the cell.

To accomplish these procedures, the selected or entire set of anodes are equipped with voltage sensors to obtain the required data. Each of these voltage sensors includes a transmitting means to relay its data to a remote computer. The remote computer includes a receiving mechanism capable of receiving the series of signals from the sensors and providing them to the computer. The computer correlates the individual signals into a current distribution profile for the cell. Optionally, based upon this current distribution, the computer may direct changes in the cell, such as the raising or lowering of anodes or changes in feeding of alumina to the cell, to balance the current distribution throughout the cell.

BRIEF DESCRIPTION OF THE DRAWING

The method and apparatus of the present invention will be more fully described with reference to the FIGURES in which.

DETAILED DESCRIPTION OF THE PREFERRED EMBODIMENTS

Figure 2:
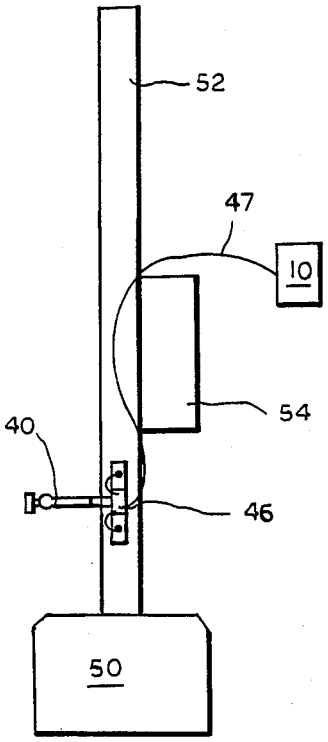
FIG. 2 is a front elevational view of an alumina reduction cell anode having the sensor employed in the present invention connected thereto.

Turning now to the FIGURES, in FIG. 2 an alumina reduction cell anode 50 is attached to a vertically movable stem 52 and is in electrical contact with an anode bus 54. An alumina reduction cell of the pre-bake anode type includes many such anodes which are maintained within a bath of electrolyte held by a cathode, as is common in the art and which is not illustrated here. According to the present invention, attached to the stem 52 is a sensor generally identified at 40. The construction and function of the sensor 40 will be more fully described below. Sensor 40 is connected through an amplifier 46 and electrical line 47 to transmitter 10.

Figure 1:
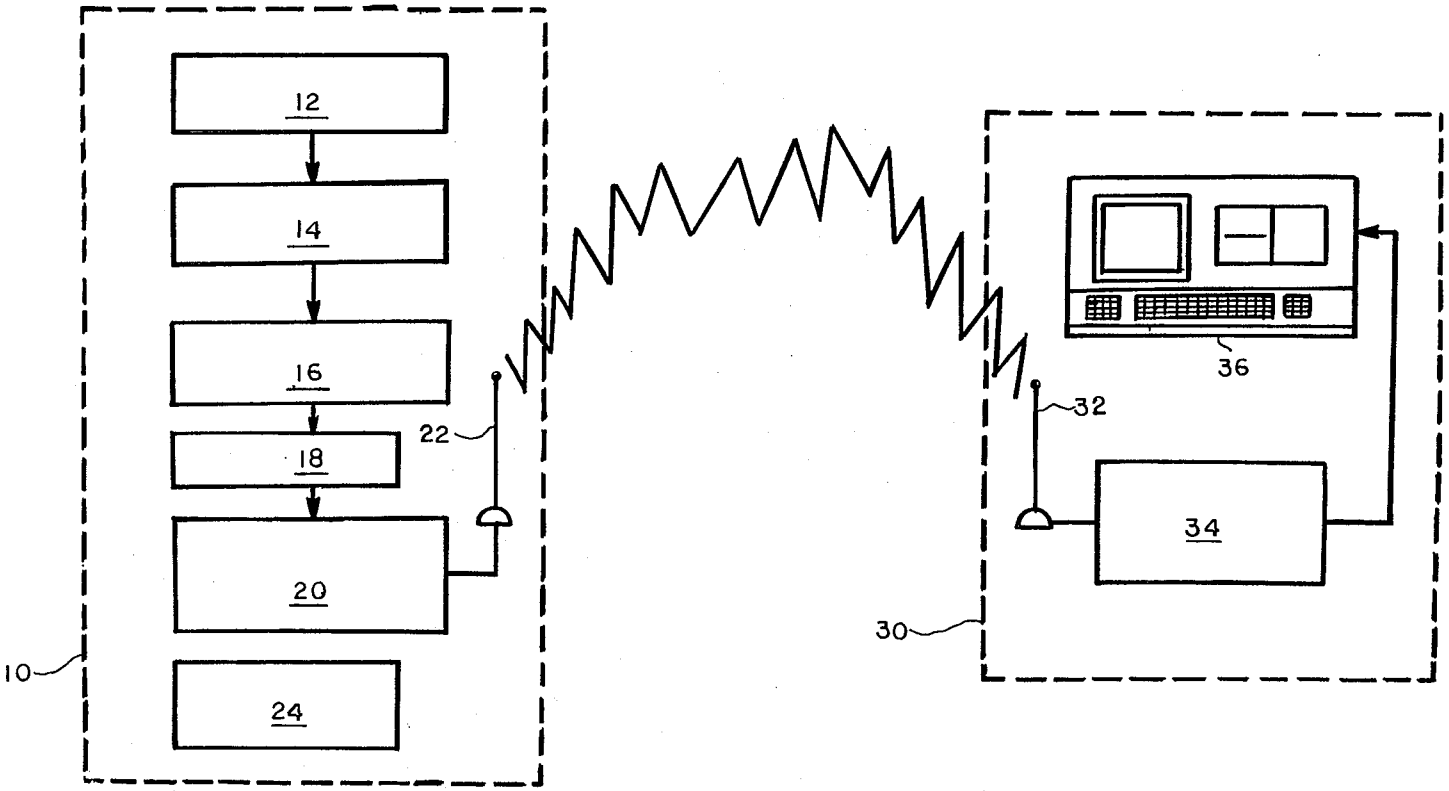
FIG. 1 is a block diagram of the data transfer system employed in the present invention.

In FIG. 1, the transmission of a signal from sensor 40 is illustrated in block form. The transmitter 10 receives a signal from sensor 40 at an input 12. This signal, which is in analog form, is transferred to an analog signal input/output board 14. The analog data is encoded to ASCII characters which are transmitted onto the multidrop RS-485 network. The digital input/output board 16 takes data derived from limit switches, solenoids, and the like and also encodes it to ASCII characters which are transmitted onto the RS-485 multidrop network. An RS-485 to RS-232 converter 18 allows the data to be fed to a radio data transceiver 20, which is preferably of the UHF-FM type, through antenna 22. The entire transmitting means 10 is powered by a DC power supply 24 connected to a source of electrical power.

At the remote location, antenna 32, which is connected to a data transceiver 34 which is similar or identical to data transceiver 20 receives signals from the transmitters 10 located throughout the cell. This data transceiver 34 is connected to the RS 232 serial port of computer 36.

One feature of the system of the present invention is that there is no direct electrical connection between the sensors 40 and the computer 36. The environment of an alumina reduction cell is hostile, with high voltage potential to earth ground ever present. Should such a high voltage potential be accidentally transferred to the computer and its related equipment, serious injury or death could befall any person in contact with this equipment. The computer system would suffer serious damage or destruction as well. The radio transmission of data gathered from numerous locations throughout the cell to a single location, preferably remote from the cell environment, eliminates any possibility of dangerous voltage potentials or stray electrical currents from the cell reaching the computer system.

The computer 36 may, in addition to correlating the data from the anodes 50 within the cell, interpret the data and adjust the cell in response to the data received in order to optimize the current distribution throughout the cell. This may be accomplished, for example, by raising or lowering certain of the anodes 50 and/or by changing the rate of alumina fed to the cell. Thus, if this is to be accomplished, the computer 36 would be connected to an apparatus for raising or lowering the anodes 50 and/or to the alumina feeders for the cell. Again, such a connection should be indirect, such as by means of radio waves, fiber optics or optoisolation so as to prevent damage to the computer 36 by high electrical currents.

The computer programs to calculate current distribution and to control the alumina reduction cell use methods well-known to those skilled in the art and themselves form no part of the present invention.

Other uses for the data obtained include modeling of the alumina reduction cell and design of improved alumina reduction cells based upon such modeling.

Figure 3:
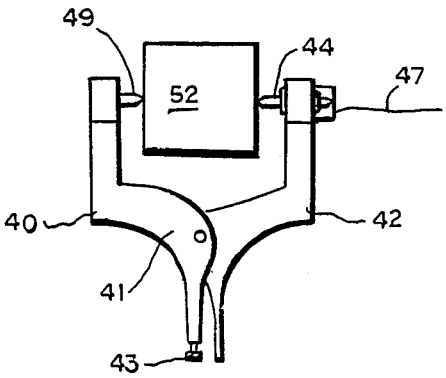
FIG. 3 is a top elevational view of the anode stem and sensor.
Figure 4:
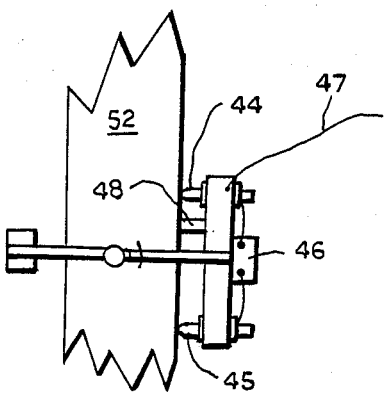
FIG. 4 is a side elevational view of the anode stem and sensor.

The sensor 40 is illustrated most completely in FIGS. 3 and 4. The sensor 40 is formed of two arms 41 and 42 which act as a pair of gripping arms, much like an adjustable vice wrench, having adjustment screw 43 for maintaining a locked grip on anode stem 52. Attached to arm 41 is a pin 49 which grips against one side of anode stem 52. This pin 49 has no electrical connection to amplifier 46 and transmitter 10, but exists solely as a gripping element against anode stem 52.

Opposite to pin 49 on arm 42 are a series of pins 44, 45 and 48. Pins 44 and 45 are the positive and negative connections respectively to anode stem 52, and thus to anode 50, between which voltage is measured. These connections 44 and 45 are electrically insulated from arm 42 to provide a floating signal to be available between these connectors.

An additional sensing device 48 is present on arm 44. This sensing device 48 is a temperature sensor which is preferably spring loaded to firmly contact anode stem 52. Voltage output varies with the temperature of the anode and thus it is important to detect changes in temperature so that thermal compensation may be accomplished, resulting in consistent voltage readings over varying temperatures. This temperature compensation may be accomplished by a circuit within amplifier 46 so that the analog signal provided along line 47 to transmitter 10, and eventually to computer 36, has been normalized for temperature or, less preferably, a temperature signal from sensor 48 could be separately transmitted through line 47 and transmitter 10 to computer 36, with the computer 36 accomplishing the thermal compensation.

The sensor 40 can be readily mounted and dismounted from anode stem 52. This is especially important when a portable system for diagnostic or research purposes is to be employed and moved from cell to cell. However, the ease of installation is also important in retrofitting an existing cell with the diagnostic equipment of the present invention.

From the foregoing, it is clear that the present invention provides a simple, yet effective method and apparatus for determining current distribution in an alumina reduction cell and optionally controlling the cell based upon the data obtained.

While the invention has been described with reference to certain specific embodiments thereof, it is not intended to be so limited, except as set forth in the accompanying claims.

I claim:

1. A method for determining current distribution among the anodes of a single alumina reduction cell comprising concurrently measuring individual current levels at a selected plurality of said anodes within said cell, transmitting said individual current levels to an electrically isolated computer and calculating the current distribution within said cell based upon said individual current levels.

2. The method of claim 1 wherein said transmitting comprises radio transmission.

3. The method of claim 1 wherein said transmitting comprises optoisolation transmission.

4. The method of claim 1 wherein said transmitting comprises fiber optics transmission.

5. The method of claim 1 further comprising optimizing said current distribution by modifying the operation of said cell.

6. The method of claim 6 wherein said optimizing comprises raising and/or lowering certain anodes within said cell.

7. The method of claim 6 wherein said optimizing comprises changing the rate of feed of alumina to said cell.

8. The method of claim 1 wherein individual current levels at each anode are measured and transmitted.

9. The method of claim 1 further comprising modeling said alumina reduction cell.

10. The method of claim 1 further comprising designing an alumina reduction cell having an optimized current distribution.

* * * * *